US007886448B2

(12) United States Patent
Humpert

(10) Patent No.: US 7,886,448 B2
(45) Date of Patent: Feb. 15, 2011

(54) ARCHERY RANGE FINDERS AND LENSES

(76) Inventor: Edward J. Humpert, 13720 Dempsey Rd., St. Charles, MI (US) 48655

( * ) Notice: Subject to any disclaimer, the term of this patent is extended or adjusted under 35 U.S.C. 154(b) by 0 days.

(21) Appl. No.: 12/584,531

(22) Filed: Sep. 8, 2009

(65) Prior Publication Data

US 2010/0000103 A1 Jan. 7, 2010

Related U.S. Application Data

(63) Continuation-in-part of application No. 12/217,047, filed on Jun. 30, 2008, now abandoned.

(60) Provisional application No. 60/958,234, filed on Jul. 3, 2007.

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | |
|---|---|---|---|---|
| 2,574,599 | A * | 11/1951 | Stieber | 124/23.1 |
| 3,136,063 | A * | 6/1964 | Stebbins | 124/87 |
| 3,666,368 | A | 5/1972 | Sprandel | |
| 3,696,517 | A * | 10/1972 | Larson | 33/265 |
| 4,109,390 | A | 8/1978 | Smith et al. | |
| 4,570,352 | A * | 2/1986 | Leal | 33/265 |
| 4,984,372 | A | 1/1991 | Blizzard | |
| 4,995,166 | A | 2/1991 | Knemeyer | |
| 5,253,423 | A * | 10/1993 | Sullivan et al. | 33/265 |
| 5,351,671 | A | 10/1994 | Cervera | |
| 6,079,111 | A | 6/2000 | Williams et al. | |
| 6,796,039 | B2 * | 9/2004 | Walbrink | 33/265 |
| 6,868,614 | B2 | 3/2005 | Floied et al. | |
| 2004/0107587 | A1 | 6/2004 | Floied et al. | |

* cited by examiner

*Primary Examiner*—Christopher W Fulton
(74) *Attorney, Agent, or Firm*—Robert L. McKellar; McKellar IP Law, PLLC

(57) ABSTRACT

Archery range finders and lenses for archery range finders, the archery range finders being intended to be mounted on an archery bow. The archery range finders allow for the archer to place the lens on the target and obtain an immediate reading of the distance that the target is from the shooter and enables the shooter to place the proper distance pin on the target without having to do any mechanical adjustments and without having to guess the distance of the target from the shooter.

22 Claims, 6 Drawing Sheets

ARCHERY RANGE FINDERS AND LENSES

This application is an original Continuation-in-Part application and claims priority from U.S. patent application Ser. No. 12/217,047, now abandoned filed Jun. 30, 2008 which is based on Provisional Patent Application U.S. Ser. No. 60/958,234, filed Jul. 3, 2007, from which priority is claimed.

The invention disclosed and claimed herein deals with an archery range finder and lens for archery range finders, the archery range finders being intended to be mounted on an archery bow. It also deals with range finders that are manufactured from metal or plastic.

The archery range finders of this invention allow for the archer to place the lens on the target and obtain an immediate reading of the distance that the target is from the shooter and enables the shooter to place the proper distance pin on the target without having to guess the distance of the target from the shooter. Further, certain of the range finders of this invention can be placed on the target and there can be an immediate reading of the distance that the target is from the shooter.

BACKGROUND OF THE INVENTION

Archery range finders are quite popular in American game hunting and there are a lot of publications via patents on such devices. One such device is disclosed in U.S. Pat. No. 3,666,368, issued on May 30, 1972 to Sprandel which deals with a sight and range finder for archers consisting of an attachment having a vertical slide on which two sliders are vertically movable.

U.S. Pat. No. 4,109,390 that issued on Aug. 29, 1978 to Smith, et al., deals with a bow sight having range finding capabilities. The device comprises a sighting frame that establishes vertically-spaced reference lines that give the apparent height of a known object at a known distance.

Knemeyer, in U.S. Pat. No. 4,995,166 that issued on Feb. 26, 1991 deals with a sight pin and top and bottom range finding pins that are mounted on a slide movable vertically relatively to the handle of an archery bow.

U.S. Pat. No. 5,351,671 that issued on Oct. 4, 1994 to Cervera deals with a sight device for mounting on the handle of an archery bow that employs a flat mounting plate and upper and lower facing rectangular mirrors orthogonally attached to the mounting plate.

Blizzard, in U.S. Pat. No. 4,984,372 that issued on Jan. 15, 1991 deals with a sighting and range finding device comprising a boxed housing having a plurality of horizontal transparent sighting elements therein having cross hair sighting reference and means for vertical adjustment.

U.S. Pat. No. 6,079,111 that issued on Jun. 27, 2000 to Williams, et al deals with a sight apparatus comprising a range finder mechanism and a pendulous sight and U.S. Patent Publication 2004/0107587 published on Jun. 10, 2004 deals with a combined target sight and range finer with a bulls-eye pin and slotted sight plate.

In a similar device, Floied, et al in U.S. Pat. No. 6,868,614 issued Mar. 22, 2005 deals with a target sight and range finder having a sight and range finder with a bulls-eye pin and slotted sight plate that has an adjustable belly bar.

All of the devices of the prior art have mechanical means or adjustability using mechanical means in order to operate.

THE INVENTION

In one embodiment, this invention deals with an archery range finder lens wherein the lens comprises a single piece of clear material having a configuration selected from the group consisting of a flat semi-circular configuration, a flat triangular configuration, a flat square configuration, and a flat rectangular configuration.

Each of the flat configurations has a front surface, a back surface, an outer edge, and a vertical center line, the front surface and back surface defining a flat plane.

Each said flat configuration has at least one attachment means in the outer edge and through the flat plane, and each flat configuration has a range finder cut near or on the vertical center line through the flat plane.

The range finder cut comprises a single lower line defining the bottom of the range finder and a series of cuts comprised of interconnected vertical and horizontal lines to define a multiple step-wise configuration defining partial windows in the lens for placing on an intended target.

Each of the horizontal cuts are configured to denote distinct distances in yards when coordinated with the single lower edge, in combination with the eye of an archer holding the range finder lens.

A further embodiment of this invention is the use of hash marks rather than full horizontal lines. Each of the hash marks denote distinct distances in yards when coordinated with the single lower edge.

Another embodiment of this invention is an archery range finder lens as set forth above in combination with a frame for holding and supporting said lens.

Yet another embodiment of this invention is an archery sight, comprising sight pins and the combination of a lens of this invention in a holder and support for the lens.

Still further, there is an embodiment of this invention which is an archery range finder comprising a solid ring having a vertical center line. There is mounted within the solid ring, a range finding apparatus, parallel to, but not aligned with said vertical center line.

This range finding apparatus comprises a supported horizontal belly bar defining the bottom of the range finding apparatus and a series of additional horizontal bars supported by and connected to a series of vertical bars to define a multiple step-wise configuration defining partial windows for placing on an intended target.

Each of the additional horizontal bars are configured to denote distinct distances in yards when coordinated with the supported horizontal belly bar in combination with the eye of an archer holding the range finder.

DETAILED DESCRIPTION OF THE INVENTION

Figure 1:
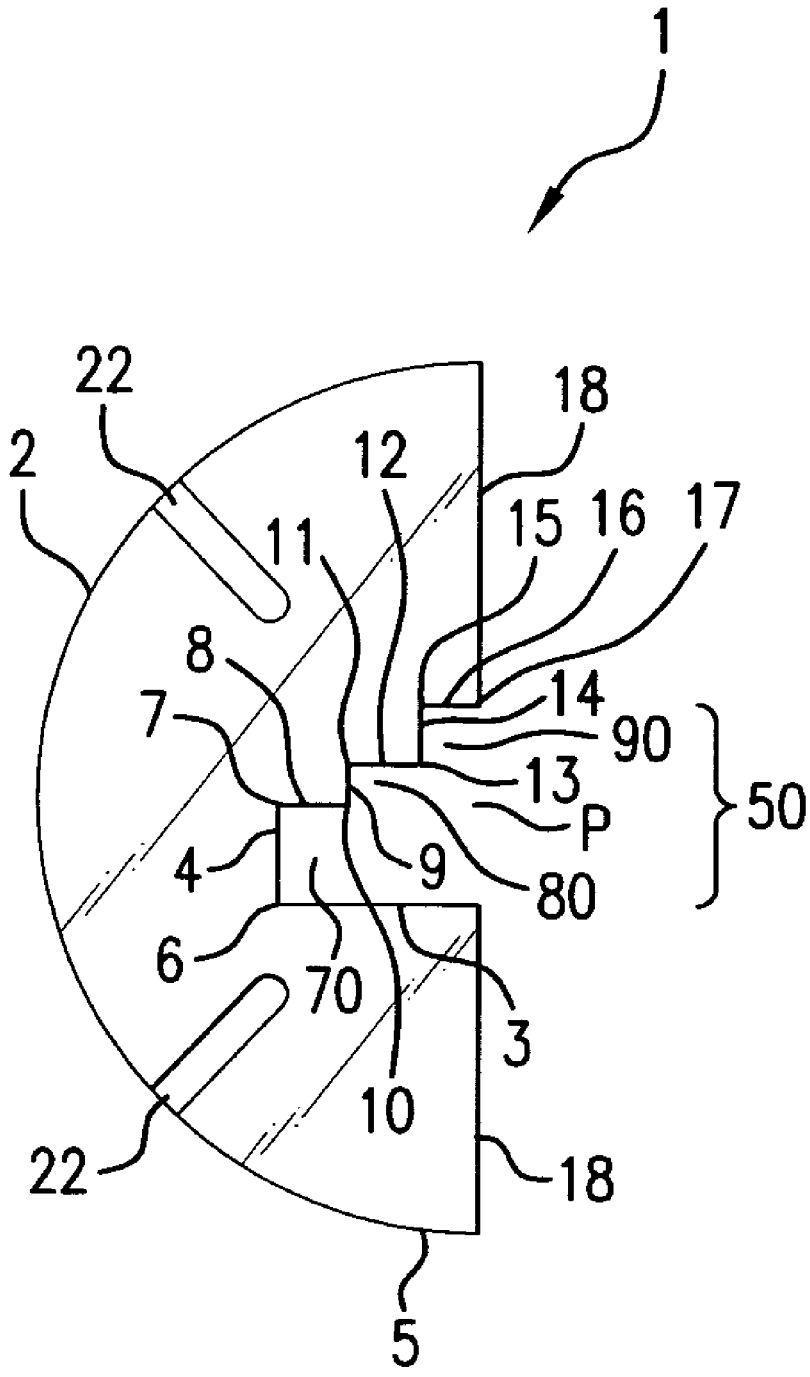
FIG. 1 is full front view of a semi-circular lens of this invention.

FIG. 1 is a full front view of a semicircular lens 1 of this invention, which is the preferred configuration herein. Shown therein for purposes of clarification and orientation is the left semi-circular edge 2, which has two attachment recesses 22 for attachment of the lens 1 to a range finder sight (described infra) using an attachment means also described infra. The use of the word "left" herein is only for purposes of orientation, as there is contemplated within the scope of this invention a lens that has a mirror image of that shown in FIG. 1, one being for right-handed archery shooters and the other being for left-handed archery shooters.

The lens can be formed from any clear material, that is, visually clear material such as plastic or glass, or the like. The lens can actually be cut from such materials, or can be formed from such materials, such as by extruding, casting, molding, or the like. Preferred is an extruded plastic material.

Formed near the vertical center point P of the semi-circular lens 1 is the range finding capability of the lens 1, generally denoted as 50. The range finding capability 50 is configured such that there is a first horizontal line 3 that forms the base line for the range finding capability 50 located towards the bottom 5 of the semi-circular lens 1. Thereafter, there is a series of interconnected horizontal and vertical lines that make up a step-wise configuration.

For example, first vertical line 4 is connected to the internal termination point 6 of the first horizontal line 3 and the top 7 the first vertical line 4. Thereafter, a second horizontal line 8 is connected to the top 7 of the first vertical line 4, a second vertical line 9 is connected to the second horizontal line 8 at the end 10, opposite of the end 7.

Further, vertical line 9 is connected at end 10 and connects at point 11 with a third horizontal line 12. The horizontal line 12 connects at point 13 with a third vertical line 14 and vertical line 14 connects at point 15 with a fourth horizontal line 16. Fourth horizontal line 16 then terminates at point 17. Thereafter, the vertical line 18 completes the leading edge of the lens 1.

It should be understood that the vertical and horizontal lines of the range finding capability 50 are predetermined such that the line 4 is longer than line 9 that is longer than line 14 and in this manner, using the bottom line 3 as a reference point, it can be determined how far away the target is from the shooter.

It is contemplated within the scope of this invention to provide all horizontal lines in the lens with bevel cuts, dyed, or painted lines in order to make such lines stand out from the lens per se. The bevel cuts provide a prism effect.

As mentioned, the partial window 70 formed by the lines 3, 4, and 8 has the widest view, that is when the bottom line 3 is placed on the bottom belly line of the intended target, the line 8 will fall on the top back line of the target if the target is 10 yards away from the shooter.

Likewise, lines 3, 9 and 12 form a second partial window 80 in which the vertical line 9 is shorter than the vertical line 4 and when the shooter places the bottom line 3 on the bottom belly line of the target, and line 12 falls on the top back line of the target, this denotes a target that is about 20 yards from the shooter.

Still further, the line 3, 14 and 16 form a third partial window 90 in which the vertical line 14 is shorter than the line 9 and when the shooter places the bottom line 3 on the bottom belly line of the target, and line 16 falls on the top back line of the target, this denotes a target that is about 30 yards from the shooter.

Figure 2:
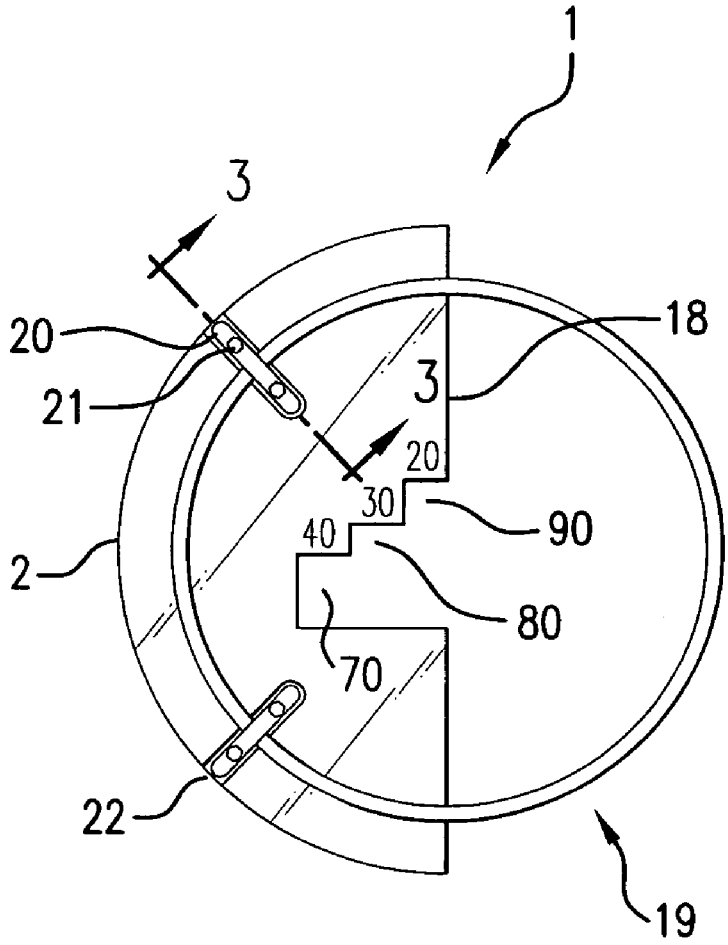
FIG. 2 is a lens of this invention showing the placement of the holder for the lens.

It is contemplated within the scope of this invention that the lens 1 can have a fourth and a fifth level to show yardages of 40 and 50 yards. It is also contemplated within the scope of this invention that these yardages can be predetermined and the lens 1 so manufactured that they encompass a range of from about 5 yards to about 70 years by adjusting the partial window sizes relative to the bottom line 3. Although, distances to target game are usually handled in yards, it is contemplated within the scope of this invention to use feet in lieu of yards. In FIG. 2, the yardage is denoted and marked directly on the lens 1, for example 20 yards, 30 yards, and 40 yards and this is optional in this invention, although it is preferred.

Elk due to their enormous size generally have a pre-set range of from 30 to 60 years, caribou generally have a pre-set range of from 30 to 60 yards, antelope are generally set from 20 to 40 yards, and mule/whitetail deer are set generally from 20 to 50 yards.

The lens 1 of this invention is mounted in a holder or support 19 for the lens 1 and the holder 19 is then mounted in an archery sight 25 having pins 26.

Thus, FIG. 2 shows one embodiment of a holder and support component 19 that is used to mount the lens 1. The holder and support component 19 consists of a ring or circular configuration 23 that has essentially the same circumferential line as the lens 1. The holder 19 is placed on the surface of the lens 1 and small plates 20 are bolted or screwed down on the lens 1 using bolts 21. In this manner, if one wishes to change from a 20 yard to 40 yard lens 1, to say, a 40 to 70 yard range lens 1, then it is readily accomplished.

Figure 3:
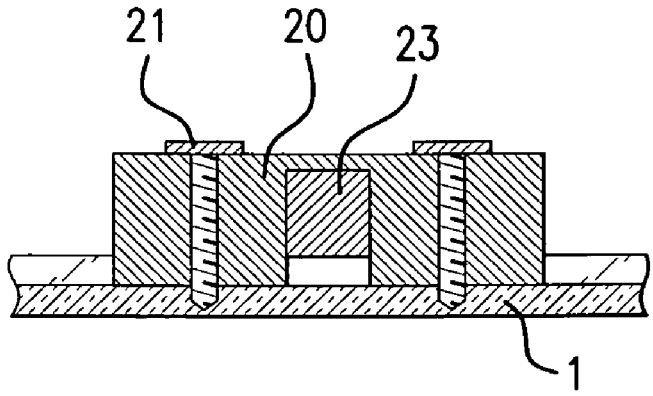
FIG. 3 is a full cross sectional view of the lens of FIG. 2 through line 3-3 of FIG. 2.

FIG. 3 is a cross sectional view thorough line 3-3 of FIG. 2 to show an enlarged view of the attachment. This is the preferred attachment means, however other means can be used as long as the ring 23 is substantially held in place and the ring 23 or its attachment means does not interfere with the view through the lens 1.

Figure 4:
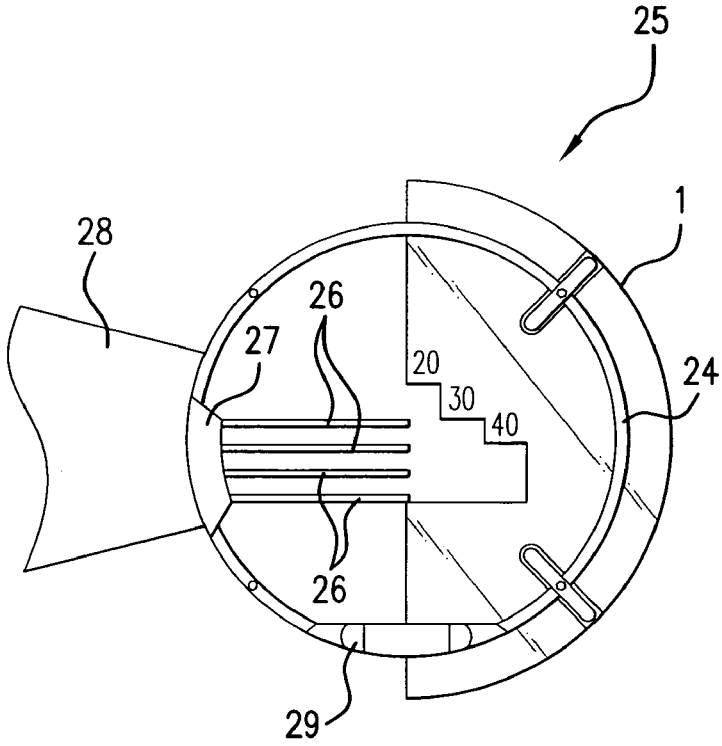
FIG. 4 is a full rear view of a semi-circular archery sight of this invention.
Figure 5:
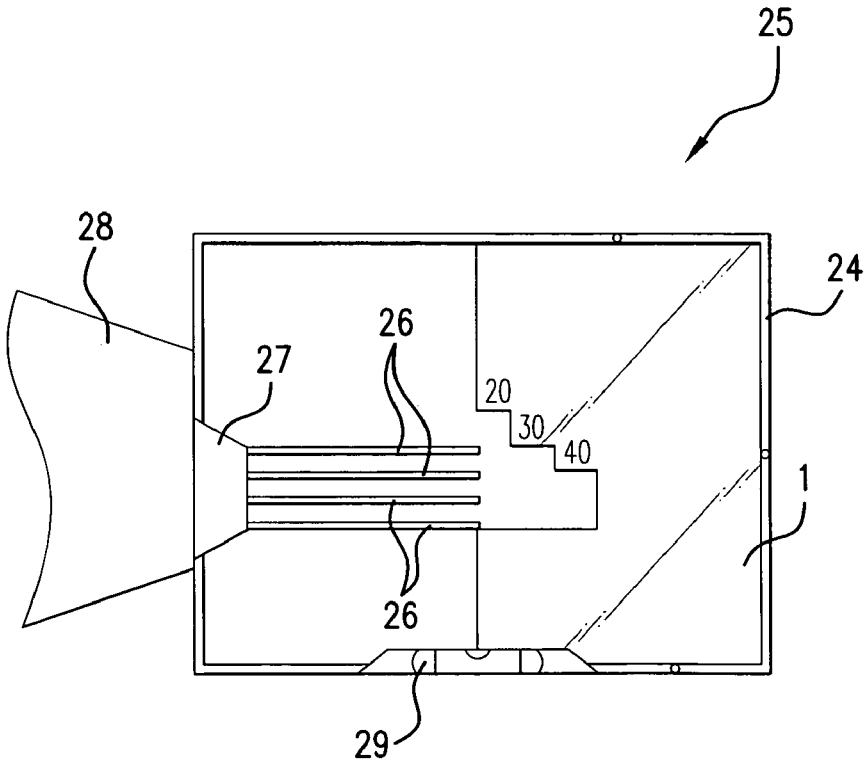
FIG. 5 is a full rear view of a rectangular archery sight of this invention.
Figure 6:
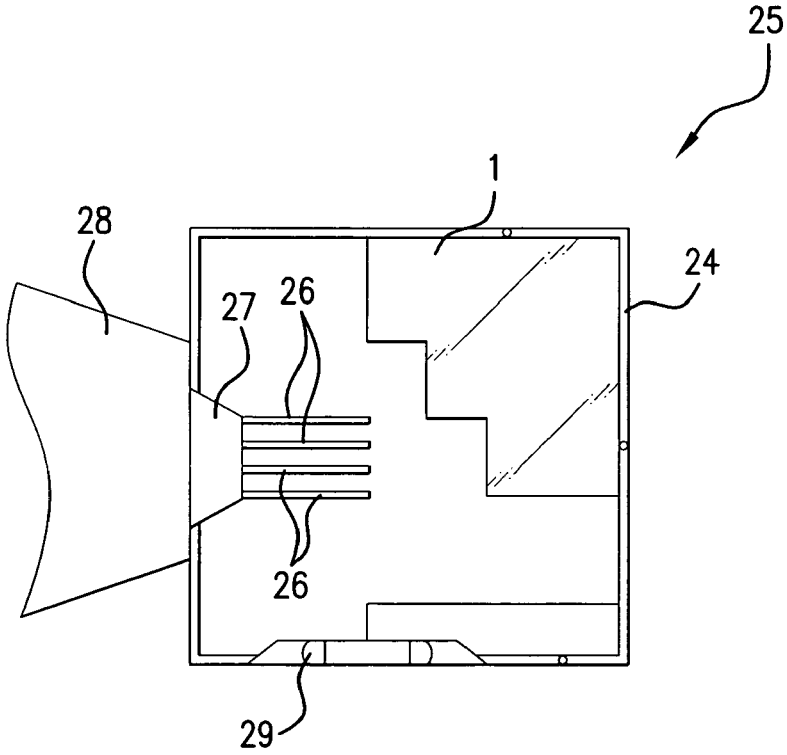
FIG. 6 is a full rear view of a square archery sight of this invention
Figure 7:
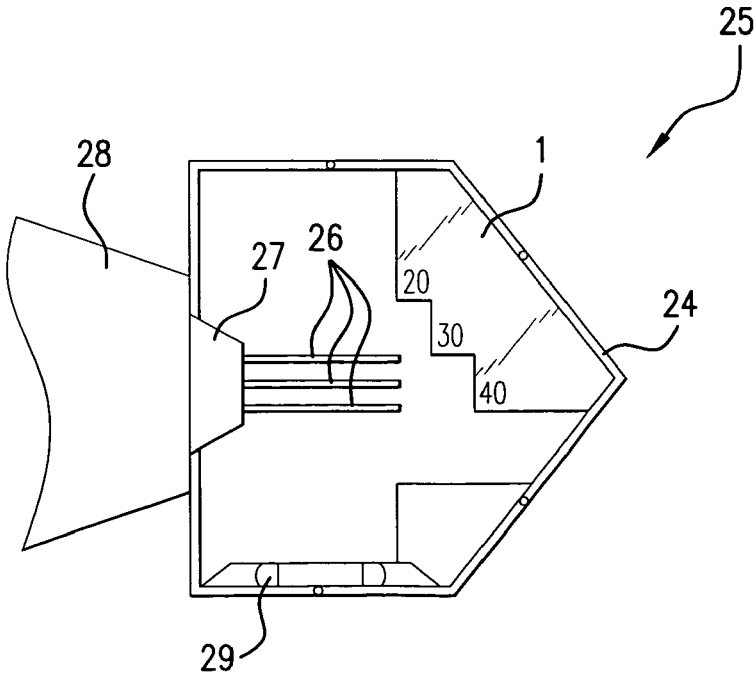
FIG. 7 is a full rear view of a triangular archery sight of this invention.

As indicated Supra, the lens 1 can have a semi-circular configuration, a triangular configuration, a square configuration, or a rectangular configuration. FIG. 4 shows an archery sight containing a semi-circular lens 1, FIG. 5 shows a rectangular configuration, FIG. 6 shows a square configuration and FIG. 7 shows a triangular configuration.

The range finder lens of this invention provides a hands-free full draw archery range finder that is designed to fit virtually any bow sight, both left and right hand models. The distances to target are pre-set and thus, there is no need to make any mechanical changes in the range finder during use, nor is it required that the shooter "sight in" such a range finder as the distances are all pre-determined and built into the lens.

Turning now to the archery sight having a semi-circular lens 1, there is shown in FIG. 4, a rear view of an archery sight 25 containing the semi-circular lens 1, a holder 24 for the lens 1, sight pins 26, attachment 27 of the sight pins 26 to the sight 25. This archery sight 25 is for a right handed shooter. In addition, there is shown an attachment means 28 for attachment of the archery sight 25 to an archery bow (not shown).

The sight pins 26, pin attachment 27, and attachment means 28 are known in the art and are conventional.

Also shown as an optional component of this invention is a level gage 29 for leveling the bow and the sight 25.

In a like manner, shown in FIG. 5 is a rectangular configuration of a lens 1 wherein like numbers in FIG. 5 have the same meanings as in FIG. 4.

In a like manner, shown in FIG. 6 is a square configuration of a lens 1 wherein like numbers in FIG. 6 have the same meanings as in FIG. 4.

In a like manner, shown in FIG. 7 is a triangular configuration of a lens 1 wherein like numbers in FIG. 7 have the same meanings as in FIG. 4.

Figure 8:
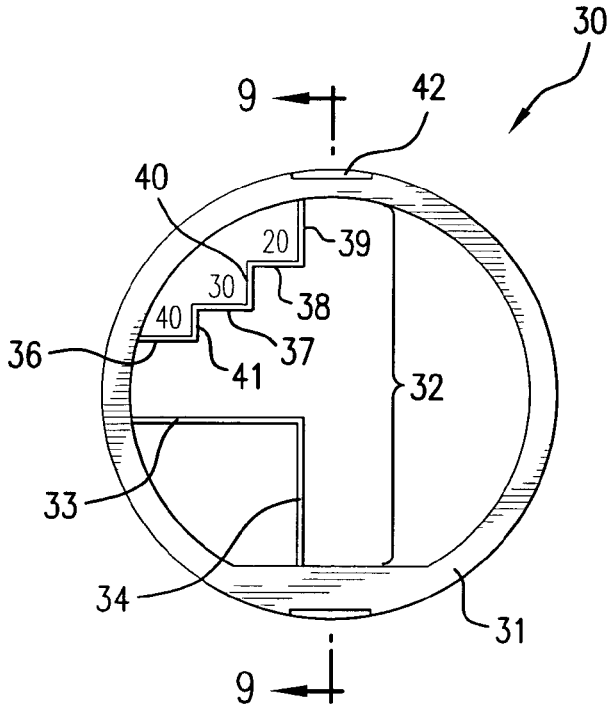
FIG. 8 is full back view of a ring range finder of this invention.
Figure 9:
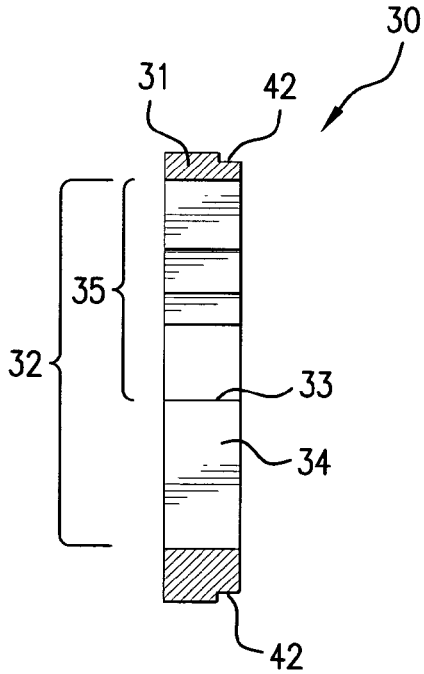
FIG. 9 is a cross sectional view of the range finder of FIG. 8 through line 9-9.
Figure 10:
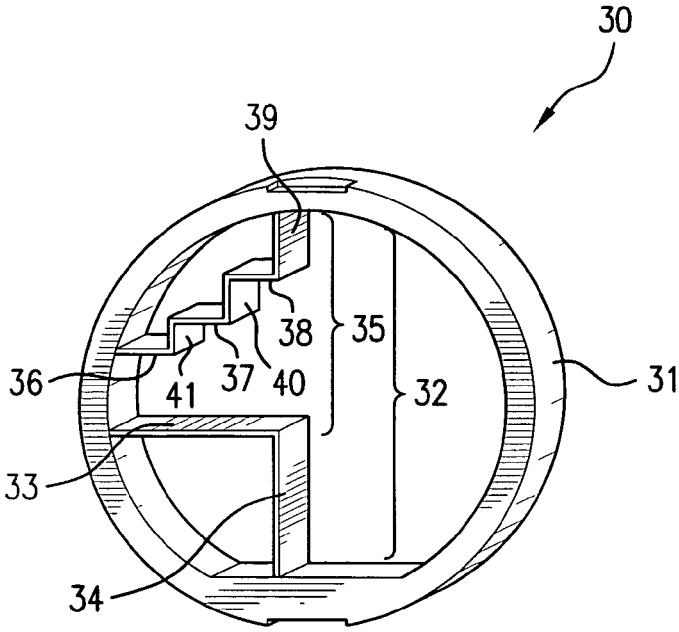
FIG. 10 is a view in perspective of the range finder of FIG. 8, showing the step-wise configuration of the range finding apparatus.

Turning now to the ring range finder of claim 9, there is shown in FIG. 8 one such range finder 30, showing the solid ring 31, and the range finding apparatus, generally at 32. Also shown on FIGS. 8 and 9 is are indentions 42 in the face of the solid ring 31 that can be used to facilitate a mechanical means to attach the range finder 30 to an archery sight. The indentions can be for example, holes drilled through the solid ring 31 to accommodate pins or screws to fasten the range finder to the archery sight. The range finding apparatus 32 is comprised of the horizontal belly bar 33, its support 34, and the step-wise configuration 35. The step-wise configuration 35 is comprised of a series of horizontal bars 36, 37, and 38 and a series of vertical bars 39, 40, and 41, all of which are connected together. The numbers 36 to 41 have been described as "bars", but they could be thins lines of metal or plastic, or flat plates (which are shown herein in FIGS. 9 and 10 by way of illustration).

Figure 11:
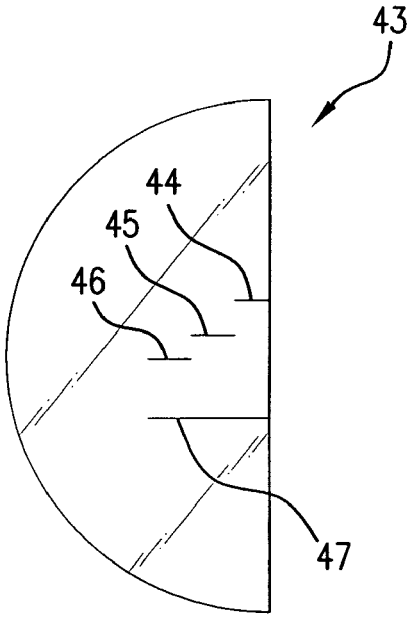
FIG. 11 is a full front view of a semi-circular lens of this invention using horizontal hash marks.

Turning now to another embodiment of this invention, the use of horizontal hash marks rather than full intersecting vertical and horizontal lines, there is shown in FIG. 11 a semi-circular lens 43 of this invention in which there are shown horizontal hash marks 44, 45 and 46, along with a bottom or belly line 47. For example, the hash mark 44 could be set at a predetermined position using a stadimeter with the distance predetermined from the belly line 47, such as 20 yards, wherein hash mark 45 may be 40 yards and hash mark 46 may be 60 yards. These predetermined distances can be set for rifle, for 25, 50, 75, 100, 125, 150, 175, and 200 yards, for example. For archery, these distances can be preset at, for example, 20 yards, 22.5 yards, 25 yards, 27.5 yards, and on up to about 60 yards just by the correct spacing between the hash marks.

Each range finder is pre-set by predetermining the size of the target from belly line to back line that fits into each partial window (in FIG. 8, largest is denoted at 100, the middle is denoted as 200, and smallest is denoted as 300) created by the vertical and horizontal lines 36 to 41 using the horizontal belly bar 33 as the base line. These dimensions differ depending on the size of the animal and therefore, range finders are manufactured with markings that describe the particular animal that the range finder is designed for. Then, each of the partial windows can be marked to indicate such sizes, for example in FIG. 8 wherein the largest partial window is indicated as 20 yards, the next largest indicated as 30 yards, and the smallest partial window indicated as 40 yards. It is not necessary to mark the partial windows, but it helps the novice hunter find the range much more readily.

The ring range finder is manufactured from metal or plastic, and more preferred is metal such as aluminum. Also preferred for the step-wise configuration are flat plates rather than thin metal lines.

The ring range finders can be attached to an archery sight by either mechanical or adhesive means and preferred is using mechanical means, especially mechanical means that can be easily removed to change range finders from one animal size to another animal size.

Figure 12:
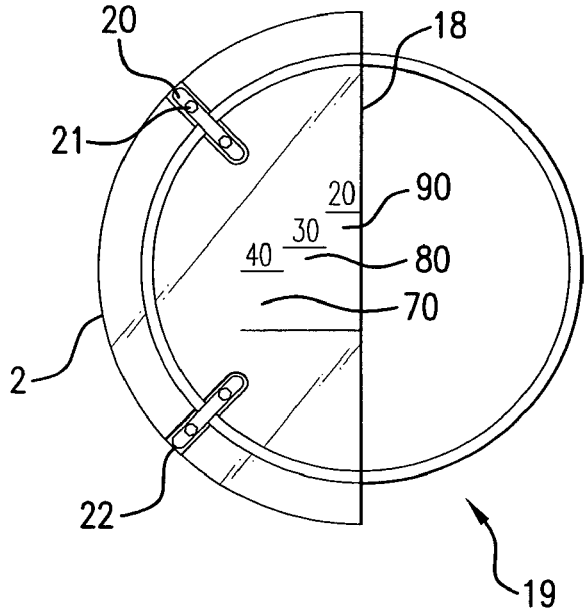
FIG. 12 is a lens of this invention showing the placement of the holder for the lens incorporating a full round lens using horizontal hash marks.

FIG. 12 is a lens of this invention wherein like components have like numbers as shown in FIG. 2. The FIG. 12 shows the placement of the holder for the lens incorporating a full round lens using horizontal hash marks.

Figure 13:
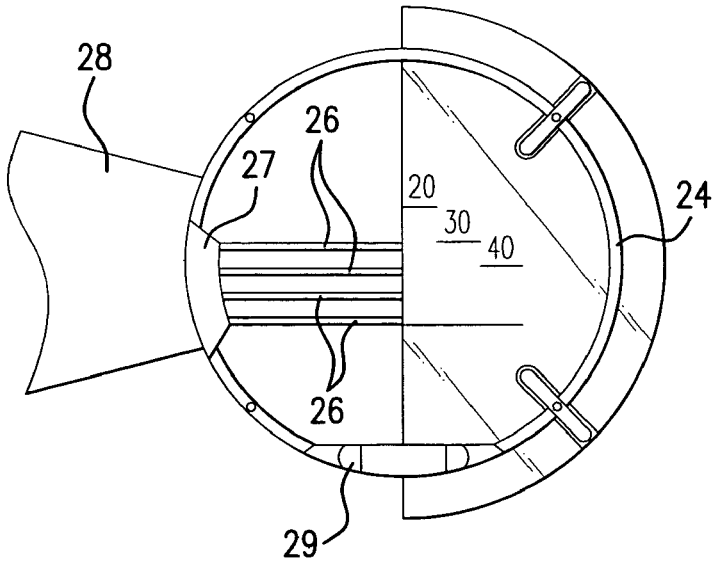
FIG. 13 is a full rear view of a semi-circular archery sight of this invention using horizontal hash marks.

FIG. 13 is a full rear view of a semi-circular archery sight of this invention using horizontal hash marks wherein like components have like numbers as shown in FIG. 4.

What is claimed is:

1. An archery range finder lens, said lens comprising a single piece of clear material having a configuration selected from the group consisting of a flat a. a semi-circular configuration, b. a triangular configuration, c. a square configuration, and d. a rectangular configuration, each said flat configuration having a front surface, a back surface, an outer edge, and a vertical center point, the front surface and back surface defining a flat plane;

each said flat configuration having at least one attachment means in the outer edge and through the flat plane, and each said flat configuration having a range finder cut near the center point through the flat plane, said range finder cut comprising a single lower line defining the bottom of the range finder and a series of cuts comprised of interconnected vertical and horizontal lines to define a multiple step-wise configuration defining partial windows in the lens for placing on an intended target, wherein each of the horizontal cuts are configured to denote distinct distances in yards when coordinated with the single lower edge in combination with the eye of an archer holding the range finder lens.

2. An archery range finder lens as claimed in claim 1 in combination with a frame for holding and supporting said lens.

3. An archery sight, comprising sight pins and the combination of claim 2.

4. An archery range finder lens as claimed in claim 2 wherein the lens is capable of fitting on an archery sight without mechanical fastening.

5. A lens as claimed in claim 1 wherein all horizontal lines are bevel cut.

6. A lens as claimed in claim 1 wherein, in addition, the lens is configured for attachment to an archery sight.

7. A lens as claimed in claim 6 wherein the lens is mechanically attached to the archery sight.

8. A lens as claimed in claim 6 wherein the attachment is reversible to allow detachment of the lens.

9. A lens as claimed in claim 6 wherein the lens is adhesively attached to the archery sight.

10. An archery range finder comprising a solid ring having a vertical center line;

mounted within said solid ring, a range finding apparatus, parallel to, but not aligned with said vertical center line;

said range finding apparatus comprising a supported horizontal belly bar defining the bottom of the range finding apparatus and a series of additional horizontal bars supported by and connected to a series of vertical bars to define a multiple step-wise configuration defining partial windows for placing on an intended target, wherein each of the additional horizontal bars are configured to denote distinct distances in yards when coordinated with the supported horizontal belly bar in combination with the eye of an archer holding the range finder.

11. An archery range finder as claimed in claim 10 wherein the range finder is configured for attachment to an archery sight.

12. An archery range finder as claimed in claim 11 wherein the range finder is mechanically attached to the archery sight.

13. A range finder as claimed in claim 12 wherein the attachment is reversible to allow detachment of the range finder.

14. A range finder as claimed in claim 11 wherein the lens is adhesively attached to the archery sight.

15. A range finder as claimed in claim 10 that is manufactured from metal.

16. A range finder as claimed in claim 15 wherein the metal is aluminum.

17. A range finder as claimed in claim 10 that is manufactured from plastic.

18. An archery range finder lens, said lens comprising a single piece of clear material having a configuration selected from the group consisting of a flat a. a semi-circular configuration, b. a triangular configuration, c. a square configuration, and d. a rectangular configuration, each said flat configuration having a front surface, a back surface, an outer edge, and a vertical center point, the front surface and back surface defining a flat plane;

each said flat configuration having at least one attachment means in the outer edge and through the flat plane, and each said flat configuration having a range finder cut near the center point through the flat plane, said range finder cut comprising a single lower line defining the bottom of the range finder and a series of cuts comprised of horizontal hash marks to define a multiple step-wise configuration defining partial windows in the lens for placing on an intended target, wherein each of the horizontal hash marks are configured to denote distinct distances in yards when coordinated with the single lower edge in combination with the eye of an archer holding the range finder lens.

19. An archery range finder lens as claimed in claim 18 in combination with a frame for holding and supporting said lens.

20. An archery sight, comprising sight pins and the combination of claim 19.

21. A lens as claimed in claim 18 wherein all horizontal hash lines are bevel cut.

22. A lens as claimed in claim 18 wherein, in addition, the lens is configured for attachment to an archery sight.

* * * * *